US010625143B1

(12) United States Patent
Kirk

(10) Patent No.: US 10,625,143 B1
(45) Date of Patent: Apr. 21, 2020

(54) HANDHELD BILLIARDS BRIDGE

(71) Applicant: Judith Ann Kirk, Kihei, HI (US)

(72) Inventor: Judith Ann Kirk, Kihei, HI (US)

( * ) Notice: Subject to any disclaimer, the term of this patent is extended or adjusted under 35 U.S.C. 154(b) by 0 days.

(21) Appl. No.: 16/350,651

(22) Filed: Dec. 12, 2018

(51) Int. Cl.
*A63D 15/10* (2006.01)

(52) U.S. Cl.
CPC ..... *A63D 15/105* (2013.01)

(58) Field of Classification Search
CPC ..... A63D 15/105
See application file for complete search history.

(56) References Cited

U.S. PATENT DOCUMENTS 570,459 A * 11/1896 Cronin ..... A63D 15/105 473/43
774,621 A * 11/1904 Van Setres ..... A63D 15/105 473/43
4,149,718 A * 4/1979 Russo ..... A63D 15/105 473/42
4,210,325 A * 7/1980 McCann ..... A63D 15/105 473/43
4,629,187 A * 12/1986 Mirowski ..... A63D 15/105 473/43
7,611,416 B1 * 11/2009 Mattina ..... A63D 15/105 473/2
2016/0296831 A1 * 10/2016 Bartolomucci ..... A63D 15/105

* cited by examiner

*Primary Examiner* — Jeffrey S Vanderveen

(57) ABSTRACT

Invention comprises a hand held device for controlling and assisting with the striking of billiard balls. A user of the device slides the device over his or her knuckles on their bridge hand and the device, rather than the user's fingers, controls and directs the movement of the cue stick. The devices consists of a rigid thermoplastic or similar material with four apertures, into which the user the inserts his or her fingers, and various protrusions creating semi-circular guides through and against which the user slides the pool cue. The guides through which the tapered fore part of the cue stick is placed are located above and adjacent to the finger holes. In certain circumstances, the user can use one of the finger holes for directing the cue stick. Additionally, certain embodiments of the device may have fully circular (enclosed) guides for the cue stick.

5 Claims, 4 Drawing Sheets

HANDHELD BILLIARDS BRIDGE

TECHNICAL FIELD OF THE INVENTION

The present invention relates to billiards cue assist devices. The device acts as a substitute for using ones hand as the bridge to guide a cue stick in striking billiards balls. The device can be used to provide assistance to those with arthritis and similar ailments, to assist those learning the sport, and to enhance accuracy.

RELATED ART

Background of the Invention

In the games of billiards, pool, snooker, and similar "cue sports", a player will typically use one hand to hold the cue stick near its weightier aft; this hand provides the forward thrusting motion for hitting the billiard ball(s). The other hand is placed in stationary position, typically on the table, and acts as a "bridge"; this hand controls and directs the cue stick.

A problem with the conventional methods of using ones hand as a bridge is that ones fingers, sweat, skin, and knuckles provide a non-consistent, and potentially adherent, surface for sliding the cue stick against. Additionally, arthritis and other disorders may prevent a player from being able to articulate their fingers into suitable positions for acting as a bridge.

The subject handheld billiards bridge provides a low friction and convenient to use alternative to the finger bridge and other mechanical bridges. In particular, the convex interior surfaces of the guides allow a full range of direction for the cue stick and provide the ideal amount of friction while accurately directing the cue stick.

The subject device is unique in that it provides a plurality of low friction positions for placing and sliding the cue stick.

DESCRIPTION OF PRIOR ART

There are several billiards and pool guides and bridges. For example, U.S. Pat. Nos. 570,459, 635,569, 1,482,962, 1,604,023, 3,563,543, 3,851,876, 4,147,346, 4,634,123, 5,141,225, 5,238,457, 5,554,075, and 5,853,333 are illustrative of prior art.

Mirowski (U.S. Pat. No. 4,629,187) discloses a pool stick guide with one hole for the cue stick and another elongated hole for the user's fingers. It is "held between the fingers and thumb" and provides a limited range of positions of methods of use. Mirowski discloses a device held in a limited position.

Buckhault (Application Pub. No. US 2015/0297977 A1) discloses a handheld pool stick guide tray.

None of the prior art discloses an invention with convex surfaces against which the pool cue slides, a plurality of easy to use guide channels, a four fingered body, or adequate features for providing "English" or spin upon the cue balls. The subject handheld bridge device unlike any prior art recognizes the necessity of: a plurality of guide locations, combined with convexed surfaces against which the cue stick is placed and slid, and an ergonomic form which is particularly helpful for arthritic players. In these respects, the handheld bridge substantially departs from the prior designs and patents.

BRIEF DESCRIPTION OF THE DRAWINGS

The following descriptions pertain to the accompanying drawings to help explain the invention's application and advantages. The use of nylon, acrylonitrile butadiene styrene, and acrylic polyvinyl chloride plastics are typical, if not ideal, materials.

DETAILED DESCRIPTION OF EXEMPLARY EMBODIMENTS

Figure 1:
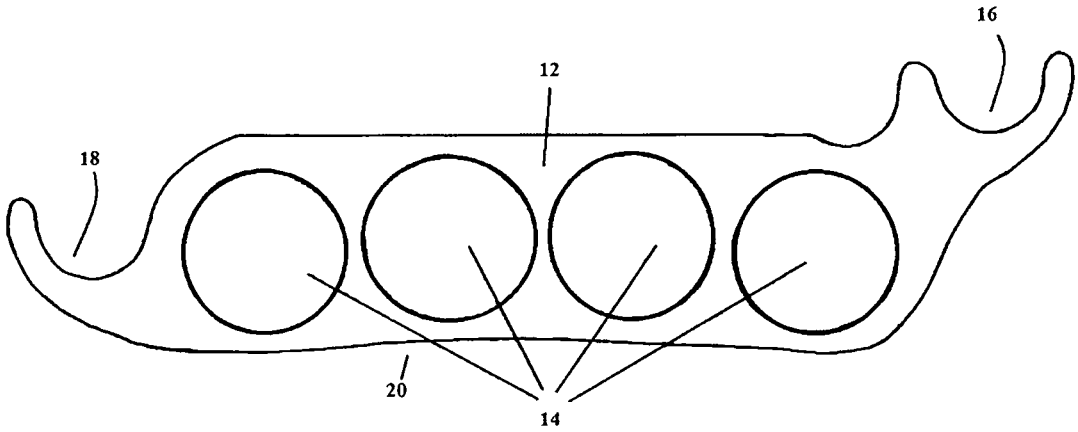
FIG. 1 is an elevation view of the device.
Figure 2:
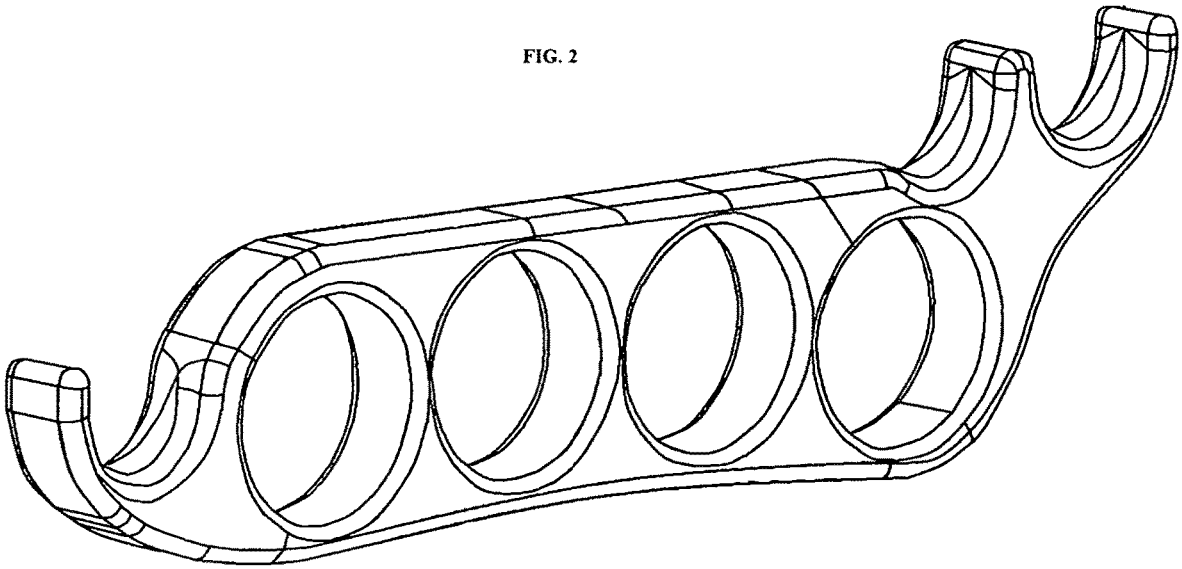
FIG. 2 is a ¾ elevation view.

An exemplary embodiment of the device, being a handheld billiards bridge, is illustrated by FIG. 1. It comprises a substantially rigid body member 12, roughly oblong in shape, made from nylon or similar rigid plastic, with four apertures 14 for the user's fingers, and manifold protrusions creating semi-circular channels 16, 18, any of which can be used as a guide in substitution for using one's hand as a bridge for a billiards cue stick.

In the exemplary embodiment, as illustrated in FIG. 1, one semi-circular guide is on each side of the body 16, 18. These guides provide the primary surface against which the pool cue is placed and slid. One guide is adjacent to, and slightly elevated to, the four finger apertures 14, 16; and the guide on the other side is fully elevated above the apertures, 14, 18 allowing the user to choose between positions for placing the cue stick.

In the exemplary embodiment and method of use, the user of the device places his or her fingers into the apertures 14 in the manner of "brass knuckles" and slides a billiards cue stick through one of the guides to strike the target billiards ball. The bottom edge of the member body is ideally slightly concave 20 and thus in the elevation view of the device, FIG. 1, the center two apertures 14 have a center that is slightly higher than the two outside apertures 14, creating a comfortable holding position for the device. In some methods of use, a user can utilize a finger aperture 14 to guide the cue stick.

Figure 3:
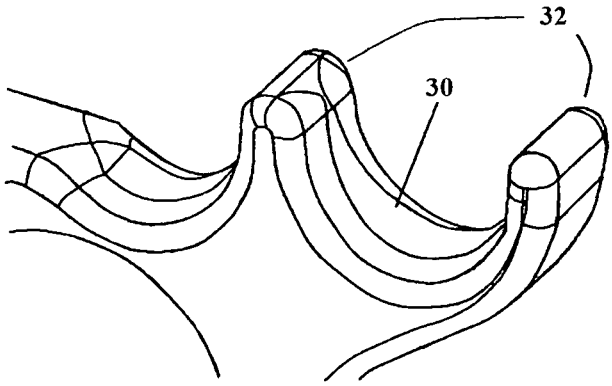
FIG. 3 is an exploded ¾ view of the device illustrating the convex interior surface of a guide.

As best illustrated by FIG. 3, the interior nadir surface of each guide is convex 30. The convexed surface 30 tapers towards the guides' projections and may terminate at roughly the mid-point of each guide's projections 32.

Figure 4:
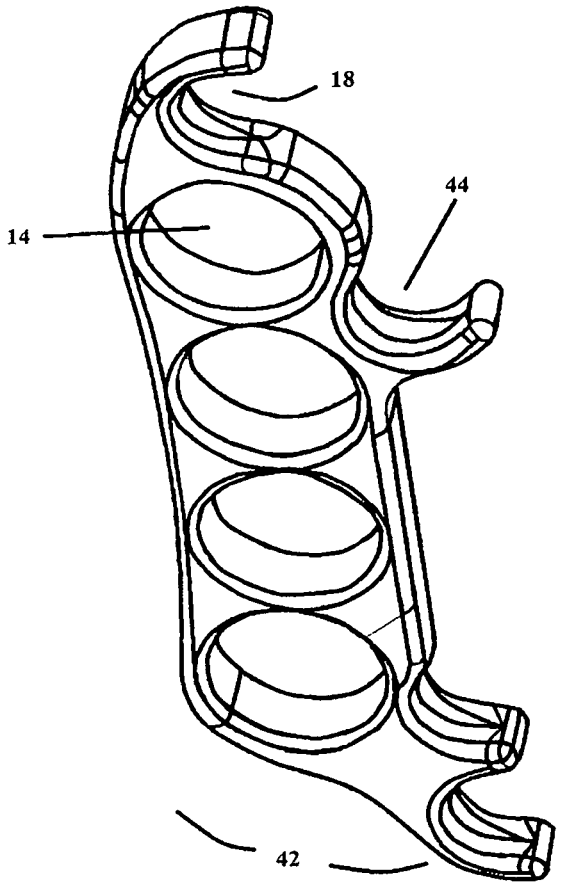
FIG. 4 is an elevation view, in vertical layout, of an embodiment of the device featuring a transverse guide above the finger apertures.

In some embodiments, shown in FIG. 4 the device may be molded to include additional channels 44 adjacent to or above the finger apertures 14 for guiding the cue stick that require unique angles. Thus, in some methods of use, as illustrated in FIG. 4, the device is placed more or less vertically on the billiards table such that the edge of the body member 42, being the edge of one outermost aperture and one guide, so that the body member is substantially transverse to the table and thus placing the opposing guide 18 at a further elevated position, giving the user a higher angle for striking the cue ball and ability to use multiple guides 44.

As noted, the exemplary embodiment of the member is nylon or other thermoplastic, however, the body member may be comprised of wood, metal, and other common materials. Other embodiments may use rubber or other polymers to add flexibility to the body member.

In some embodiments, the device may have additional fully circular guides adjacent to the four apertures. Such circular guides may be affixed to the member body rubberized or other fasteners, allowing for limited movement, for among other things, applying English to certain pool shots. The rubberized fasteners, along with a convex lower surface in the circular guide allow limited expansion to provide resistance for the cue stick. Other means and materials adding circular guides may be used.

With respect to the above descriptions and Figures, it is noted that the device may consist of a variety of materials and can be built to a range of dimensional specifications, including as to size, weight, and proportions of features, and all such variations are intended to be encompassed by the present invention. It is also believed to be understandable by those skilled in the art that while one embodiment of the invention is described herein, other embodiments and modifications of the one described are possible within the scope of the invention which is limited only by the attached claims.

The invention claimed is:

1. A handheld billiards bridge device, for guiding billiards cue sticks, comprising:

an elongated, reniform body member comprised of a rigid material with a concave lower edge and a thin cross section;

four finger apertures in the body member which are substantially linear to one another and into which fingers of a user may be inserted, such that, corresponding with the reniform shape of the body member, two of the four said finger apertures are elevated compared to the other two finger apertures;

a semi-circular guide, comprised of a protrusion from the body member with a convex interior edge, at one end of the body member that is substantially linear and elevated to the four finger apertures;

and a semi-circular guide, comprised of two protrusion on the body member with convex interior edges, that is fully elevated to the finger apertures.

2. A handheld billiards bridge as in claim 1 in which a fifth aperture is placed above the finger apertures featuring rubberized inserts which move and compress incrementally, disposed to add pressure to the cue stick.

3. A handheld billiards bridge as in claim 1 in which a third semi-circular guide is placed above the finger apertures at an angle such that the nadir of said semi-circular guide is transverse to the other semi-circular guides.

4. A handheld billiards bridge as in claim 1 in which a quarter-circular depression is located above the finger apertures.

5. A handheld billiards bridge as in claim 1 in which an elastomer or other flexible material replaces the rigid material of the elongated body between the center two finger apertures to allow the elongated body member to flex.

* * * * *